US008511043B2

(12) United States Patent
Fyfe

(10) Patent No.: US 8,511,043 B2
(45) Date of Patent: Aug. 20, 2013

(54) SYSTEM AND METHOD OF REINFORCING SHAPED COLUMNS

(75) Inventor: Edward R. Fyfe, Del Mar, CA (US)

(73) Assignee: Fyfe Co., LLC, San Diego, CA (US)

( * ) Notice: Subject to any disclaimer, the term of this patent is extended or adjusted under 35 U.S.C. 154(b) by 223 days.

(21) Appl. No.: 12/932,446

(22) Filed: Feb. 24, 2011

(65) Prior Publication Data

US 2011/0219710 A1 Sep. 15, 2011

Related U.S. Application Data

(60) Continuation-in-part of application No. 12/583,100, filed on Aug. 15, 2009, now Pat. No. 7,930,863, which is a division of application No. 11/399,282, filed on Apr. 6, 2006, now Pat. No. 7,574,840, which is a continuation-in-part of application No. 10/205,294, filed on Jul. 24, 2002, now Pat. No. 7,207,149.

(51) Int. Cl.
*E04C 5/00* (2006.01)
*E04C 3/30* (2006.01)

(52) U.S. Cl.
USPC ..... 52/834; 52/841; 52/847; 52/223.4; 52/223.8; 52/223.14; 52/838

(58) Field of Classification Search
USPC ..... 52/834–835, 842, 847, 849–850, 52/223.13, 223.14, 582.1–585.1, 707, 698, 52/700, 703, 706, 708, 712, 261, 271–272, 52/286, 256, 606–607, 596, 600, 223.4, 169.9, 52/169.14, 838, 223.8, 586.1, 223.1, 745.17; 403/169–170, 172
See application file for complete search history.

(56) References Cited

U.S. PATENT DOCUMENTS

| | | | | |
|---|---|---|---|---|
| 513,794 | A | 1/1894 | Lee | |
| 2,371,882 | A | 3/1945 | Freyssinet | |
| 2,593,022 | A | 4/1952 | Grivel et al. | |
| 2,637,885 | A | 5/1953 | Silver | |
| 2,737,802 | A * | 3/1956 | Bakker | 52/223.13 |
| 2,751,881 | A | 6/1956 | Burkey | |
| 2,809,586 | A | 10/1957 | Roberts | |
| 3,086,273 | A * | 4/1963 | Welborn | 264/228 |
| 3,087,681 | A * | 4/1963 | Riester | 239/284.1 |
| 3,222,842 | A | 12/1965 | Luedloff et al. | |
| 3,247,635 | A | 4/1966 | Burns | |
| 3,461,639 | A | 8/1969 | Merrill | |
| 3,464,173 | A | 9/1969 | Ros | |
| 3,513,609 | A * | 5/1970 | Lang | 52/223.6 |
| 3,530,631 | A | 9/1970 | Guddal | |
| 3,738,071 | A | 6/1973 | Finsterwalder | |
| 3,757,528 | A | 9/1973 | Finsterwalder et al. | |

(Continued)

OTHER PUBLICATIONS

Office action issued Dec. 24, 2003 in related U.S. Appl. No. 10/205,294 now issued as 7,207,149—7 pgs.

(Continued)

*Primary Examiner* — Jeanette E. Chapman
(74) *Attorney, Agent, or Firm* — Senniger Powers LLP

(57) ABSTRACT

Reinforcing system (10) for reinforcing structures with irregular surfaces, such as shaped columns. Fiber-reinforced plastic sheathing (25) is wrapped around or over the surface to be reinforced and fiber anchors (50) are installed at high stress areas, such as re-entrant corners. Cover strip (30) spreads force among fiber anchors (50) and provides a smooth finish.

8 Claims, 1 Drawing Sheet

(56) References Cited

U.S. PATENT DOCUMENTS

| | | | | |
|---|---|---|---|---|
| 3,813,837 | A * | 6/1974 | McClain et al. | 52/309.1 |
| 3,820,832 | A | 6/1974 | Brandestini et al. | |
| 3,877,235 | A | 4/1975 | Hill | |
| 4,056,036 | A | 11/1977 | Kamann et al. | |
| 4,409,764 | A | 10/1983 | Wilnau | |
| 4,441,289 | A | 4/1984 | Ikuo et al. | |
| 4,838,970 | A | 6/1989 | Thibos | |
| 4,866,897 | A | 9/1989 | Yount | |
| 5,016,411 | A | 5/1991 | Thorsnes | |
| 5,218,810 | A * | 6/1993 | Isley, Jr. | 52/834 |
| 5,555,696 | A * | 9/1996 | Morrison et al. | 52/309.1 |
| 5,567,374 | A | 10/1996 | Thicthener et al. | |
| 5,607,527 | A * | 3/1997 | Isley, Jr. | 156/71 |
| 5,617,685 | A | 4/1997 | Meier et al. | |
| 5,649,398 | A | 7/1997 | Isley, Jr. et al. | |
| 5,657,595 | A * | 8/1997 | Fyfe et al. | 52/252 |
| 5,675,943 | A | 10/1997 | Southworth | |
| 5,678,382 | A | 10/1997 | Naito | |
| 5,713,169 | A | 2/1998 | Meier et al. | |
| 5,809,712 | A | 9/1998 | Simanjuntak | |
| 5,845,457 | A | 12/1998 | Wybauw | |
| 5,925,579 | A * | 7/1999 | Neuner et al. | 442/175 |
| 6,216,403 | B1 | 4/2001 | Belbeoc'h | |
| 6,327,825 | B1 | 12/2001 | Sanders et al. | |
| 6,345,473 | B1 | 2/2002 | Fink et al. | |
| 6,363,681 | B1 * | 4/2002 | Neuner | 52/834 |
| 6,367,214 | B1 | 4/2002 | Monachino | |
| 6,524,045 | B2 | 2/2003 | Pourtier | |
| 6,524,980 | B1 | 2/2003 | Fensel et al. | |
| 6,526,722 | B1 | 3/2003 | Pangburn | |
| 6,571,518 | B1 | 6/2003 | Barley | |
| 6,647,674 | B1 | 11/2003 | Lancelot, III et al. | |
| 6,647,678 | B1 | 11/2003 | Zambelli et al. | |
| 6,892,504 | B1 | 5/2005 | diGirolamo et al. | |
| 7,673,432 | B2 * | 3/2010 | Teng | 52/745.17 |
| 7,685,788 | B1 | 3/2010 | Torres et al. | |
| 2004/0016200 | A1 | 1/2004 | Fyfe | |
| 2009/0211194 | A1 | 8/2009 | Fyfe et al. | |

OTHER PUBLICATIONS

Response filed Mar. 29, 2004 to Office Action dated Dec. 24, 2003 regarding related U.S. Appl. No. 10/205,294 now issued as 7,207,149—11 pgs.

Office action issued May 14, 2004 in related U.S. Appl. No. 10/205,294 now issued as 7,207,149—7 pgs.

Response filed Jul. 16, 2004 to Office Action dated May 14, 2004 regarding related U.S. Appl. No. 10/205,294 now issued as 7,207,149—10 pgs.

Office action issued Mar. 9, 2005 in related U.S. Appl. No. 10/205,294 now issued as 7,207,149—5 pgs.

Response filed Aug. 9, 2005 to Office Action dated Mar. 9, 2005 regarding related U.S. Appl. No. 10/205,294 now issued as 7,207,149—6 pgs.

Office action issued Sep. 28, 2010 in related U.S. Appl. No. 12/459,013 now issued as 7,980,033—7 pgs.

Response filed Dec. 28, 2010 to Office Action dated Sep. 28, 2010 regarding related U.S. Appl. No. 12/459,013 now issued as 7,980,033—5 pgs.

Office action issued Apr. 13, 2010 in related U.S. Appl. No. 12/583,100 now issued as 7,930,863—6 pgs.

Response filed Oct. 13, 2010 to Office Action dated Apr. 13, 2010 regarding related U.S. Appl. No. 12/583,100 now issued as 7,930,863—8 pgs.

International Search Report and Written Opinion concerning related PCT Application Serial No. PCT/US2012/047157 dated Oct. 16, 2012, 9 pages.

* cited by examiner

SYSTEM AND METHOD OF REINFORCING SHAPED COLUMNS

CROSS-REFERENCE TO RELATED APPLICATIONS

This application is a Continuation-in-Part of application Ser. No. 12/583,100, filed Aug. 15, 2009, now U.S. Pat. No. 7,930,863 which is a Division of application Ser. No. 11/399,282, filed Apr. 6, 2006, which issued Aug. 18, 2009 as U.S. Pat. No. 7,574,840 B1; which is a Continuation-in-Part of application Ser. No. 10/205,294, filed Jul. 24, 2002, which issued on Apr. 24, 2007 as U.S. Pat. No. 7,207,149 B2.

FIELD OF THE INVENTION

This invention relates in general to reinforcing a structure, and more particularly to reinforcement of a support column of complex shape.

BACKGROUND OF THE INVENTION

Structures such as buildings and bridges have traditionally been designed to support their own weight plus that of expected loads from people, vehicles, furnishings, etc. Buildings and other structures for supporting weight have long been expected to be very strong under vertical compression. Concrete is a favorite material for weight-bearing structures because it is inexpensive and has exceptional compressive strength.

However, many existing commercial and public structures are not strong enough to survive having one or more support columns destroyed by an explosion, earthquake, or impact. These existing structures need to be reinforced in order to meet current standards of safety. The related applications listed in the Cross-Reference section, above, disclose various methods for reinforcing the attachment among various components of a structure, such as beams, decks, walls, and columns in order to increase the structure's strength and safety.

In some cases, reinforcement of support columns themselves, in addition to connection of components, is necessary to provide sufficient safety. In other cases, reinforcement of support columns alone is sufficient to make the structure safe.

Conventional methods of reinforcing support columns can be broadly described as adding one or more additional layers to the column: pouring additional concrete around the column; welding metal supports, such as panels or bands, around the column; or wrapping the column in fiber-reinforced plastic sheathing. The purpose of adding more material is to allow the column to sway and deform, such as in an earthquake or hurricane, without the internal steel rods or bars buckling and possibly rupturing the column. The columns of many existing structures were designed without sufficient constraint of the internal steel.

Fiber-reinforced plastic (FRP) wrapping is a preferred method because it can be installed quickly with little disruption to the use of the structure. FRP material can be viewed as either a fabric that is saturated with polymer resin, or plastic that includes embedded fabric. The fabric is typically woven or knitted from fibers with high tensile strength, such as graphite carbon or high-strength glass.

FRP may be applied to a column while the resin is "wet", i.e., not yet cross-linked and containing solvents, or when the resin is gelled and has little solvent, but not yet cross-linked. FRP may also be created in situ by wrapping the column with fabric then saturating the fabric by applying resin with a roller, sprayer, or brush.

The FRP sheathing has low mass, so it can be installed on upper floors of a building without increasing the load on lower floors. FRP sheathing is relatively thin and can conform to the original contours of the building. FRP sheathing increases the apparent ductility of the column so that it is more resistant to forces other than vertical compression. Also, if the reinforced column does fail under catastrophic forces, the failure will typically be more gradual than that of a column reinforced with concrete or metal, allowing occupants time to escape the building or even time for emergency repairs to be performed.

FRP sheathing has been widely accepted as an effective method of reinforcing standard columns of rectangular and cylindrical cross-section. However, some existing buildings have columns of more complex shape in cross-section, including concavities or re-entrant corners. Conventional FRP sheathing is considered less effective for these types of columns because of the potential for adhesive failure on complex surfaces. However, steel or concrete jacketing are undesirable because they destroy the aesthetic effect of the shaped columns. As the state of Washington Dept. of Transportation says about one of their bridges, "The bridge has cruciform "+" shaped columns that make it architecturally unique as well as a challenge to strengthen against earthquakes using steel column jackets."

There is thus a need for a method of reinforcing support columns of complex shape that will preserve the many benefits and advantages of FRP sheathing, including retention of historic or aesthetic features, while overcoming the potential shortcoming of possible adhesive failure.

SUMMARY

In a first aspect, the present invention is directed to an improved system for sheathing columns with fiber-reinforced plastic (FRP) to strengthen the columns. Some columns have concavities such as fluting, vertical notches, or re-entrant corners and require special methods for sheathing.

In a another aspect, the present invention is directed to a first layer of FRP sheathing wrapped around the column and attached to it with adhesive. A line of ductile fibers is installed through the first layer of sheathing, along the deepest part of the notch or fluting. The free ends of the fiber anchors are splayed over the first layer of sheathing and attached with adhesive. A second layer of FRP sheathing is may be attached over the first layer and the free ends of the fiber anchors.

In another aspect, the present invention is directed to a cover strip of FRP attached along the notch or fluting. Preferably, the FRP sheathing is installed with the grain (direction of greatest strength) oriented horizontally but the cover strip is oriented vertically.

The invention will now be described in more particular detail with respect to the accompanying drawings, in which like reference numerals refer to like parts throughout.

DETAILED DESCRIPTION OF THE INVENTION

Figure 1:
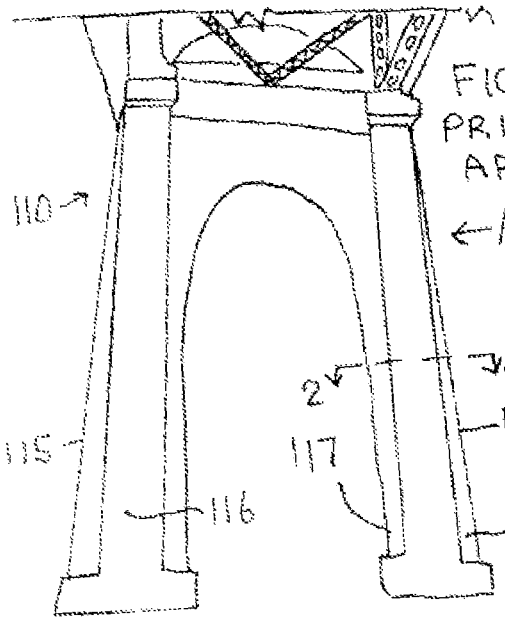
FIG. 1 PRIOR ART
FIG. 1 is a perspective view, partly cut away, of a prior art support structure for a bridge.

FIG. 1 is a perspective view, partly cut away, of an exemplary prior art structure, such as support pier 110 for a bridge 100. Support pier 110 includes a pair of shaped columns 115 joined at their tops.

Figure 2:
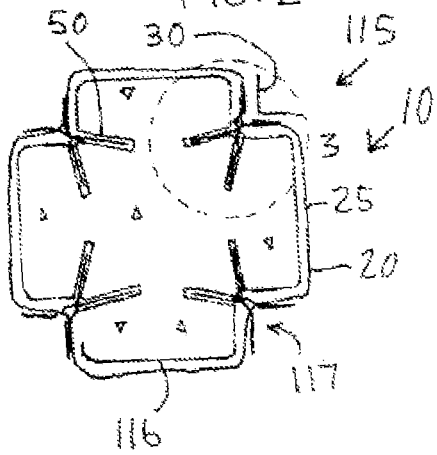
FIG. 2 is a sectional view of a support pier of the bridge of FIG. 1, taken along line 2 - - -2 and further showing an embodiment of a reinforcement system of the present invention in partly exploded view.

FIG. 2 is a sectional view of one shaped column 115 of FIG. 1, taken along line 2 - - -2 and further showing an embodiment of a reinforcement system 10 of the present invention in partly exploded view.

Figure 3:
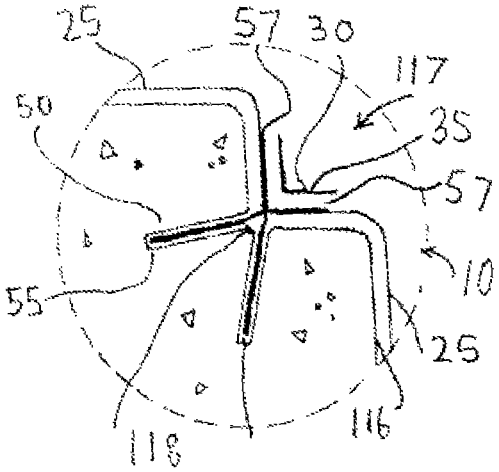
FIG. 3 is an enlarged detail view of area 3 of FIG. 2.

FIG. 3 is an enlarged detail view of one corner of the sectional view of column 115 as shown in area 3 of FIG. 2, with reinforcement system 10 shown in partly exploded view.

Shaped columns 115 are overall generally square in horizontal cross-section, but with a notch, or "re-entrant corner" 117 removed from what would have been the four corners of the square. Columns 115 thus have four "external" faces 116 and four re-entrant corners 117. Each re-entrant corner 117 is a dihedral angle with a line of intersection 118.

As best seen in FIG. 1, shaped columns 115 taper in width such that the cross-sectional area decreases with increasing height. The complex shape of columns 115 results in less intimidating bulk for people passing below bridge 100, provides protected niches for conduits, and offers a distinctive appearance even from a distance.

Reinforcing shaped columns 115 with conventional concrete or steel jackets would probably destroy this aspect of bridge 100's design. An attempt to create concrete or steel jackets mimicking the cruciform shape of shaped columns 115 would be extremely expensive and would likely be only partially successful. Because of the added bulk, any historical value of the design would be lost or diminished and surrounding infrastructure would have to modified, for example, adjacent roads might be narrowed, trees removed, or private property condemned.

Reinforcement system 10 of the present invention is a conformal sheathing of fiber-reinforced plastic (FRP) that strengthens shaped columns 115 as well as a conventional concrete or steel jacket would, but is sufficiently thin that the shape and dimensions of columns 115 are not changed much. System 10 generally includes fabric sheathing 20, such as FRP panels with horizontal grain, wrapped around column 115, ductile fasteners such as fiber anchors 50 arrayed along dihedral intersection 118, and an optional cover strip 30, such as FRP panel with vertical grain 35. The components of system 10 are attached to column 115 and to each other by suitable adhesive means.

Column 115 is prepared for installation of reinforcement system 10 by drilling boreholes 55 on or next to dihedral intersection 118. Debris and dirt is removed from boreholes 55 and external surfaces of column 115 by brushing, vacuuming, compressed air, steam, or other cleaning processes as needed. An adhesion primer (not shown) may be applied to all surfaces if needed. Also, adhesive means, such as pasty epoxy 65 is applied to dihedral intersection 118 to create a radiused corner, typically of half an inch radius or greater.

Column 115 is prepared for installation of reinforcement system 10 by drilling boreholes 55 on or next to dihedral intersection 118. Debris and dirt is removed from boreholes 55 and external surfaces of column 115 by brushing, vacuuming, compressed air, steam, or other cleaning processes as needed. An adhesion primer (not shown) may be applied to all surfaces if needed. Also, adhesive means, such as pasty epoxy 65 is applied to dihedral intersection 118 to create a radiused corner, typically of half an inch radius or greater.

A first layer of FRP 25 is wrapped around column 115, allowing sufficient slack that FRP 25 can be pressed fully into re-entrant corner 117. FRP 25 is preferably laid up such that the edges meet or overlap slightly over one of external faces 116.

FRP 25 is composed of a woven or knitted fabric made of high-strength yarns such as of graphite carbon or glass, saturated with a polymer resin such as epoxy. The fabric may be of a single type of fiber or may be blended, so as to provide the strength and ductility characteristics required. FRP 25 can be prepared in situ by dipping strips of suitable fabric into liquid resin and spreading the fabric immediately around column 115, or FRP 25 can be prepared beforehand by saturating fabric with resin then allowing the resin to gel. The resulting flexible panels of FRP 25 can be cut and handled easily, but the gelled resin will still affix FRP 25 strongly to column 115 upon curing.

The attached FRP 25 is pressed into re-entrant corners 117 and slits are cut or punched over each borehole 55 that was previously drilled. A fiber anchor 50 is inserted into each borehole 55 with free ends 57 protruding through the slit in attached FRP 25. Borehole 55 is filled the rest of the way with suitable adhesive means such as grout or backfill epoxy. Free ends 57 are splayed apart and attached to FRP 25 sheathing covering the surface of re-entrant corner 117, such as the dihedral surface opposing the surface in which borehole 55 was drilled. Free ends 57 are attached to FRP 25 with suitable adhesive means such as backfill epoxy.

Fiber anchors 50 tie FRP sheathing 25 strongly to re-entrant corners 117 such that deflection of column 115 in an earthquake will not pop or peel FRP 25 loose from re-entrant corner 117. The purpose of radiusing the interior angle with pasty epoxy 65 is to ensure that no unattached gap is formed at dihedral intersection 118.

Figure 4:
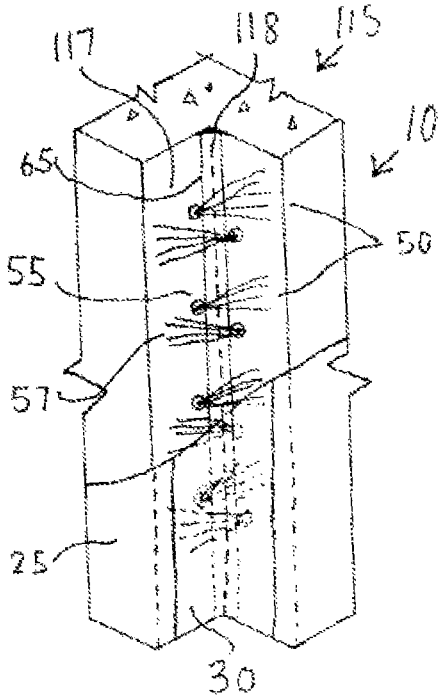
FIG. 4 is a perspective view, partly cut away, of one component of an embodiment of a repair system of the present invention.

FIG. 4 is a perspective view, partly cut away, of a preferred installation of fiber anchors 50 in re-entrant corner 117. Boreholes 55 are drilled alternately into opposing faces of re-entrant corner 117, just beside the fillet of pasty epoxy 65, and the boreholes 55 are partly filled with backfill epoxy. A fiber anchor 50, typically consisting of a length of roving 56 pre-saturated with adhesive such as epoxy, is inserted into each borehole 55 with free end 57 protruding through a slit or hole provided in FRP 25. Additional adhesive (not shown) is inserted to fill borehole 55, such as by injection. Free end 57 is splayed apart and attached to the face of re-entrant corner 117 that opposes the face in which borehole 55 is drilled.

Fiber anchors 50 thus anchor FRP sheathing 25 into re-entrant corner 117, which is an area of high tensile and peeling forces on FRP 25 when column 115 deflects laterally. Fiber anchors 50 prevent FRP 25 from peeling or popping away from re-entrant corner 117 under stress.

An additional strip of fabric, such as cover strip 30, such as a strip of FRP with vertical grain 35, is optionally attached with suitable adhesive means along the length of re-entrant corner 117 to cover fiber anchors 50. The yarns embedded in cover strip 30 may be the same material as FRP sheathing 25, or may be different, depending upon the application. As described above regarding the attachment of FRP 25, adhesive means is typically an epoxy, which may be either a liquid or gelled resin. Cover strip 30 provides a smooth external surface in re-entrant corner 117 and helps spread forces among fiber anchors 50.

In some cases, it is preferable to include a second layer of FRP 25 sheathing (not shown). This second layer is applied much the same as the first layer, described above, but without being pierced by fiber anchors 50. The second layer may be installed either directly over fiber anchors 50, with cover strip 30 attached over the second layer of FRP 25, or may be installed after and on top of cover strip 30. Because FRP 25 is quite thin, even two layers of FRP sheathing 25 plus cover strip 30 add only about half an inch to the profile of column 115. Except for the slight radiusing of dihedral intersection 118, all surface features and dimensions of the original shaped column 115 are substantially retained. Reinforcement system 10 is translucent and allows the original surface to show through. If desired, a finish coat of paint to match the original color may be applied.

Mechanical testing has shown that reinforcement system 10 meets or exceeds current standards for seismic safety, yet is less expensive and faster to install than conventional concrete or steel jackets. Because the original dimensions are retained, public acceptance of the retrofitting project is far greater than for jacketing type reinforcement that often requires a long period of disruption during installation, may encroach into existing roads or private property, and forever changes the appearance of the structure.

Although particular embodiments of the invention have been illustrated and described, various changes may be made in the form, composition, construction, and arrangement of the parts herein without sacrificing any of its advantages. For example, although the exemplary embodiment described herein is reinforcement of a cruciform column, the system and method can also be applied with the same benefits to many other structures with niches, fluting, banding, or similar surface features. Therefore, it is to be understood that all matter herein is to be interpreted as illustrative and not in any limiting sense, and it is intended to cover in the appended claims such modifications as come within the true spirit and scope of the invention.

I claim:

1. A system for reinforcing a column that includes an elongate, generally linear concavity, including:

a fabric sheathing layer wrapped around the column and attached by suitable adhesive means;

a plurality of ductile fiber anchors inserted through said fabric sheathing layer and disposed within boreholes drilled along the deepest part of the concavity; including:

free ends attached to an adjacent surface of the column with adhesive means; and a cover strip attached over said fiber anchors and attached to said fabric sheathing layer by suitable adhesive means.

2. A reinforcement system for protecting a vertically elongate concrete structure against seismic and other lateral forces; including:

a fabric sheathing layer attached to the structure by suitable adhesive means;

at least one ductile fastener additionally connecting said sheathing layer to an area in which said fabric sheathing will be exposed to high tensile or peeling forces if the elongate structure deflects substantially; and a cover strip covering said fiber anchors and attached by suitable adhesive means.

3. The reinforcement system of claim 2, further including:

a second fabric sheathing layer attached by adhesive means over said fiber anchors and below said cover strip.

4. The reinforcement system of claim 2, further including:

a second fabric sheathing layer attached by adhesive means over said cover strip.

5. A reinforcement system for columns having re-entrant corners, including:

a first FRP panel wrapped around the perimeter of the column and substantially covering the height of the column; said panel attached by adhesive means;

a plurality of fiber anchors disposed along the interior angle of the re-entrant corner to reinforce the attachment of said first FRP panel to the re-entrant corner; and a cover strip attached over said fiber anchors inside the re-entrant corner.

6. The reinforcement system of claim 5, said first FRP panel being disposed such that the grain is substantially perpendicular to the longitudinal axis of the column.

7. The reinforcement system of claim 5, said cover strip being disposed such that the grain of said cover strip is substantially parallel to the longitudinal axis of the column.

8. The reinforcement system of claim 5, the column further including a series of boreholes on or beside the dihedral intersection of the re-entrant corner for accepting said fiber anchors; said first FRP panel including a plurality of holes; each said hole disposed over one borehole; and each said fiber anchor including:

a free end passing through and protruding from one said hole in said FRP panel; said free end attached by adhesive means to an adjacent surface of the column.

* * * * *